US010175007B2

(12) United States Patent
Wang et al.

(10) Patent No.: US 10,175,007 B2
(45) Date of Patent: Jan. 8, 2019

(54) CERAMIC HEAT EXCHANGE PLATE AND CERAMIC HEAT EXCHANGE CORE ASSEMBLED THEREBY

(71) Applicant: CAS SUPER ENERGY TECHNOLOGY JINGJIANG LTD., Jingjiang, Jiangsu (CN)

(72) Inventors: Fengze Wang, Jiangsu (CN); Xinyu Zhang, Jiangsu (CN); Zhongyu Xia, Jiangsu (CN); Yu Zhang, Jiangsu (CN)

(73) Assignee: CAS SUPER ENERGY TECHNOLOGY JINGJIANG LTD., Jingjiang, Jiangsu (CN)

( * ) Notice: Subject to any disclaimer, the term of this patent is extended or adjusted under 35 U.S.C. 154(b) by 144 days.

(21) Appl. No.: 15/038,695

(22) PCT Filed: Nov. 12, 2014

(86) PCT No.: PCT/CN2014/090927
§ 371 (c)(1),
(2) Date: May 23, 2016

(87) PCT Pub. No.: WO2016/045175
PCT Pub. Date: Mar. 31, 2016

(65) Prior Publication Data

US 2016/0298911 A1 Oct. 13, 2016

(30) Foreign Application Priority Data

Sep. 24, 2014 (CN) ..... 2014 1 0492831

(51) Int. Cl.
*F28D 7/02* (2006.01)
*F28F 3/00* (2006.01)
(Continued)

(52) U.S. Cl.
CPC ..... *F28D 21/001* (2013.01); *F28D 9/0037* (2013.01); *F28D 9/02* (2013.01);
(Continued)

(58) Field of Classification Search
CPC ..... F28D 9/0037; F28D 9/02; F28D 21/0003; F28D 21/001; F28F 3/02; F28F 3/048; F28F 3/10; F28F 21/04; F28F 3/04
(Continued)

(56) References Cited

U.S. PATENT DOCUMENTS 1,571,068 A * 1/1926 Stancliffe ..... F28D 7/0025 122/32
1,662,870 A * 3/1928 Stancliffe ..... F28D 9/0037 165/166
(Continued)

FOREIGN PATENT DOCUMENTS

CN 2041803 U 7/1989
CN 201443778 U 4/2010
(Continued)

*Primary Examiner* — Jason Thompson
(74) *Attorney, Agent, or Firm* — Novick, Kim & Lee, PLLC; Allen Xue

(57) ABSTRACT

The present invention relates to a ceramic heat exchange plate and a ceramic heat exchange core assembled thereby. The ceramic heat exchange core comprises sealing strips, and the ceramic heat exchange plate. A plurality of ceramic heat exchange plates A and a plurality of ceramic heat exchange plates B are alternately superimposed. Side sealing strips are arranged inside top linear sealing grooves of the ceramic heat exchange plates A and bottom linear sealing grooves of the ceramic heat exchange plates B. Side sealing strips are arranged inside top linear sealing grooves of the ceramic heat exchange plates B and bottom linear sealing grooves of the ceramic heat exchange plates A. A plurality of ceramic heat exchange plates A, a plurality of ceramic heat exchange plates B and a plurality of sealing strips are
(Continued)

assembled to form a ceramic heat exchange core. The ceramic heat exchange core is integrally sintered.

2 Claims, 5 Drawing Sheets

(51) Int. Cl.

| | |
|---|---|
| ***F28D 21/00*** | (2006.01) |
| ***F28D 9/02*** | (2006.01) |
| ***F28D 9/00*** | (2006.01) |
| ***F28F 3/04*** | (2006.01) |
| ***F28F 3/10*** | (2006.01) |
| ***F28F 21/04*** | (2006.01) |
| *F24H 9/00* | (2006.01) |

(52) U.S. Cl.
CPC ..... *F28F 3/04* (2013.01); *F28F 3/048* (2013.01); *F28F 3/10* (2013.01); *F28F 21/04* (2013.01); *F24H 9/0084* (2013.01)

(58) Field of Classification Search
USPC ..... 165/166, 165
See application file for complete search history.

(56) References Cited

U.S. PATENT DOCUMENTS

| | | | | |
|---|---|---|---|---|
| 3,262,496 | A * | 7/1966 | Bawabe | F28D 9/0068 165/166 |
| 4,083,400 | A | 4/1978 | Dziedzic et al. | |
| 4,130,160 | A * | 12/1978 | Dziedzic | F28D 9/0037 165/166 |
| 4,488,920 | A | 12/1984 | Danis | |
| 4,681,157 | A * | 7/1987 | Schwarz | F28F 7/02 165/145 |
| 5,228,515 | A * | 7/1993 | Tran | F28D 9/0037 165/166 |
| 6,267,176 | B1 * | 7/2001 | Bolla | F28D 9/0062 165/166 |
| 2009/0071638 | A1 * | 3/2009 | Murayama | F24F 3/147 165/166 |
| 2010/0006274 | A1 * | 1/2010 | Cho | F28D 9/0037 165/166 |
| 2012/0325445 | A1 * | 12/2012 | Dinulescu | B21D 51/52 165/166 |

FOREIGN PATENT DOCUMENTS

| | | | |
|---|---|---|---|
| CN | 102269420 | A | 12/2011 |
| CN | 102538546 | A | 7/2012 |

* cited by examiner

CERAMIC HEAT EXCHANGE PLATE AND CERAMIC HEAT EXCHANGE CORE ASSEMBLED THEREBY

TECHNICAL FIELD OF THE INVENTION

The present invention relates to the technical field of industrial furnaces, in particular to a ceramic heat exchange plate used in flue gas waste heat recovery systems of various industrial furnaces and boilers, and a ceramic heat exchange core assembled thereby.

BACKGROUND OF THE INVENTION

An air pre-heater includes a heat exchange element made of ceramic material. The heat exchanger made of ceramic material has been applied. Such heat exchangers, having an applicable temperature generally up to 1400° C. are especially suitable for waste heat recovery from the high-temperature flue gas. Meanwhile, due to the corrosion resistance of the ceramic material, such heat exchangers are also suitable for waste heat recovery from the low-temperature flue gas. The technical status is as shown in the following publications:

U.S. Pat. No. 4,681,157, titled "Crossflow Heat Exchanger";

U.S. Pat. No. 4,083,400, titled "Heat Recuperative Apparatus Incorporating a Cellular Ceramic Core"; and Chinese Patent ZL201010619070.7, titled "Silicon Carbide Ceramic Heat Exchange Plate and Manufacturing Method Thereof".

U.S. Pat. No. 4,681,157 provides a crossflow heat exchanger, a heat exchange main body thereof is formed by laying a plurality of cube honeycomb ceramic pieces and the cube honeycomb ceramic pieces include a plurality of intersected rectangular through holes having a small cross-section; and the air tightness of the heat exchange main body is ensured by grooves and flanges on the four sides of the side faces of the cube honeycomb ceramic pieces, sealing strips are arranged between each pair of grooves and flanges, and the contact sides of ceramic heat exchange elements are sealed by grouting.

U.S. Pat. No. 4,083,400 provides two honeycomb ceramic cores for a waste heat recovery device. The first honeycomb ceramic core is formed by bonding corrugated ceramic slices and ceramic flat plate spacers with a certain thickness together, and the ceramic spacers are configured to separate flue gas and air. The second honeycomb ceramic core is formed by laminating and bonding the ceramic spacers having fins on one side together. With regard to the first core, the ceramic spacers are likely to generate an internal stress and thus to crack due to the bonding of the corrugated ceramic slices and the ceramic flat plate spacers. With regard to the second core, it may be better. However, for both cores, the volume thereof will not be too large. Because the heat exchanger in this patent is a single-core heat exchanger, it does not involve the connecting and sealing problems of a plurality of honeycomb ceramic cores. It is not suitable for manufacturing multi-core heat exchangers.

Chinese Patent ZL201010619070.7 provides a silicon carbide ceramic heat exchange plate, characterized in that a heat exchange channel of a double-loop structure is arranged on the heat exchange plate, and is an arc-shape or a linear deep groove. This patent does not involve sealing and connection among the plates; and furthermore, the thickness of a single plate and the groove depth are limited. It is not suitable for heat exchange between air and flue gas.

At present, ceramic tube heat exchangers have been applied to the waste heat recovery from the high-temperature flue gas, but hardly applied to the waste heat recovery from the medium- and low-temperature flue gas. Ceramic plate heat exchangers have been hardly applied to the waste heat recovery from the high-, medium- and low-temperature flue gas.

SUMMARY OF THE INVENTION

An objective of the present invention is to provide a ceramic heat exchange plate and a ceramic heat exchange core assembled thereby by the ceramic heat exchange plate. The pre-heater is reasonable in structure and convenient to manufacture, and can improve the air tightness, corrosion resistance and wear resistance of products and greatly prolong the service life of products.

The present invention is implemented as follows: a ceramic heat exchange plate is provided, including a central heat exchange plate having a plurality of upper fins and lower fins on an upper face and a lower face thereof, characterized in that the central heat exchange plate has four sides and four corners; a second side and a fourth side are arranged in a lower portion of the corners, a linear groove is respectively arranged on outer side faces and bottoms of the second side and the fourth side, and the linear groove on the outer side face of the second side or the fourth side and grooves on two corners form a U-shaped sealing groove; a first side and a third side are arranged in an upper portion of the corners, a top linear groove is respectively arranged on the outer side faces and tops of the first side and the third side, and the linear groove on the outer side face of the first side or the third side and grooves on two corners form an inverted U-shaped sealing groove; the four sides have a same structure but a different mounting position and mounting direction; the four corners have a same structure and are mirror symmetrical to each other; the central heat exchange plate is a flat plate; the upper fins and the lower fins are respectively arranged on the upper face and lower faces of the central heat exchange plate, the fin length directions of the upper fins are arranged along the X-axis, and the fin length directions of the lower fins are arranged along the Y-axis. Each of the upper fins and the lower fins is configured to provide a surface area for heat transfer.

The ceramic heat exchange plate of the present invention and a ceramic heat exchange core assembled thereby are provided, the ceramic heat exchange core including sealing strips and the ceramic heat exchange plate; a plurality of ceramic heat exchange plates A and a plurality of ceramic heat exchange plates B are alternately superimposed; side sealing strips are arranged inside top linear sealing grooves of the ceramic heat exchange plates A and bottom linear sealing grooves of the ceramic heat exchange plates B; side sealing strips are arranged inside top linear sealing grooves of the ceramic heat exchange plates B and bottom linear sealing grooves of the ceramic heat exchange plates A; a plurality of ceramic heat exchange plates A, a plurality of ceramic heat exchange plates B and a plurality of sealing strips are assembled to form a ceramic heat exchange core; a solid face is respectively provided on an upper face and a lower face of the ceramic heat exchange core, a □-shaped groove A is respectively arranged above and below a left end face and a right end face, and a □-shaped grooves B is respectively arranged on a front side face and a rear side face; a U-shaped groove is respectively arranged above the □-shaped grooves B, and an inverted U-shaped groove is respectively arranged below the □-shaped grooves B; an end face porthole is arranged in a left and right direction of the ceramic heat exchange core, a side face porthole is arranged in a front and rear direction, and the end face porthole and the side face porthole are not communicated to each other; and the ceramic heat exchange core is integrally sintered The present invention is reasonable in structure and convenient to manufacture, and improves the air tightness, corrosion resistance and wear resistance of products and greatly prolongs the service life of products.

IN THE DRAWINGS

Figure 1:
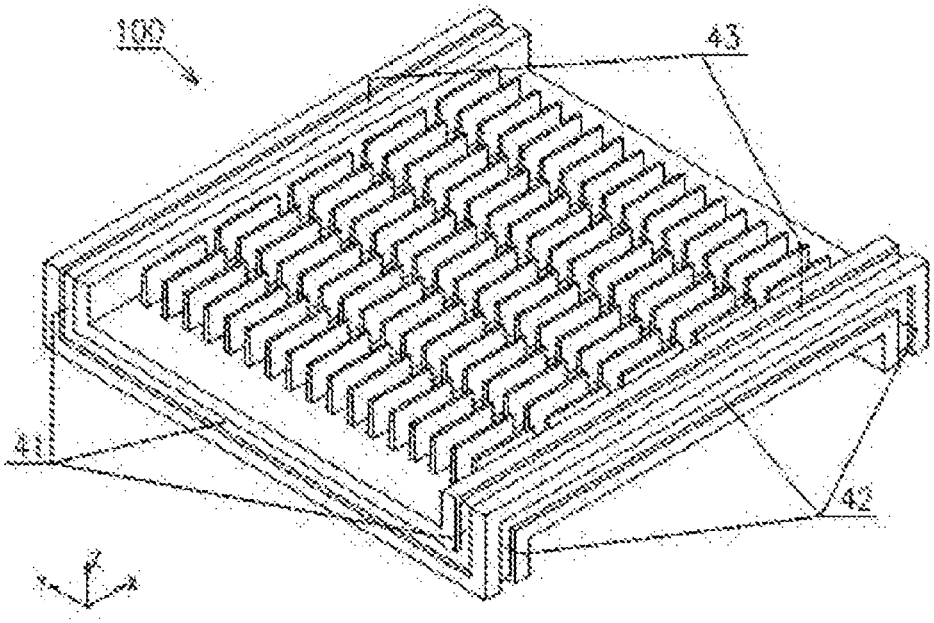
FIG. 1 is a three-dimensional top view of a ceramic heat exchange plate 100 according to the present invention (angle of view: absolute to WCS, 225° from the X-axis, 35.3° from the XY plane)
Figure 2:
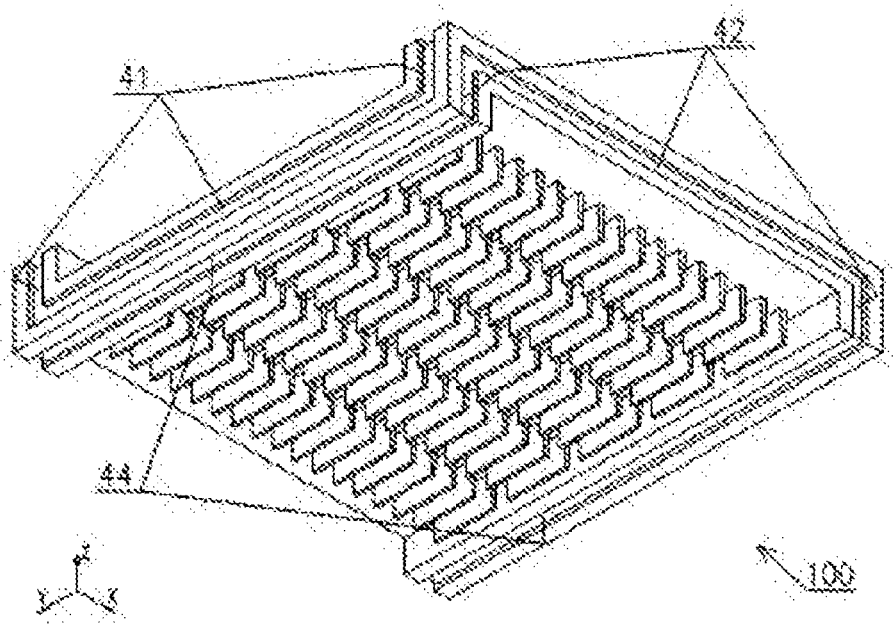
FIG. 2 is a three-dimensional bottom view of the ceramic heat exchange plate 100 according to the present invention (angle of view: absolute to WCS, 225° from the X-axis, −35.3° from the XY plane)
Figure 3:
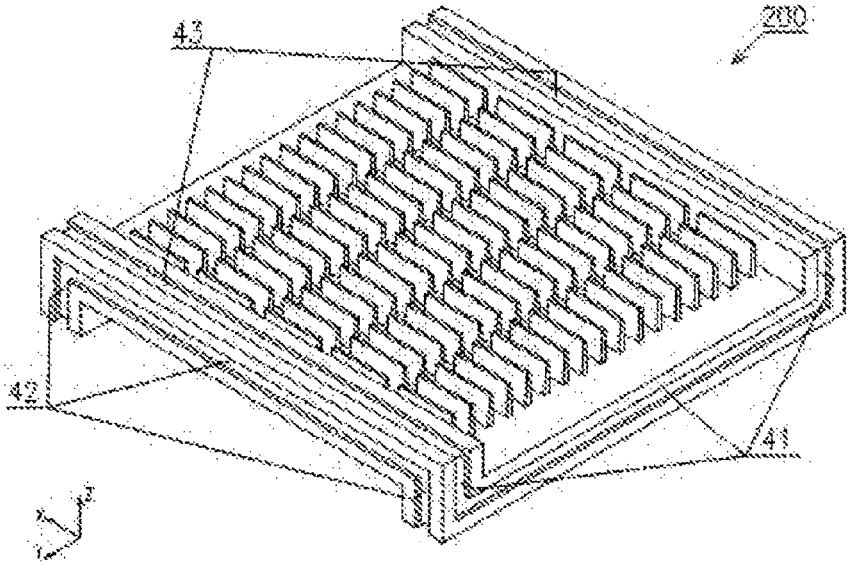
FIG. 3 is a three-dimensional top view of a ceramic heat exchange plate 200 formed by rotating the ceramic heat exchange plate 100 of FIG. 1 by 90° in the XY plane.

3: side sealing strip;
41: U-shaped groove;
42: inverted U-shaped groove;
43: top linear sealing groove;
44: bottom linear sealing groove;
45: □-shaped groove A;
46: □-shaped groove B;
50: end face porthole;
51: side face porthole;
100: ceramic heat exchange plate A;
101: first corner;
102: second corner;
103: third corner;
104: fourth corner;
111: first side;
112: second side;
113: third side;
114: fourth side;
120: central heat exchange plate;
121: upper fin;
122: lower fin;
200: ceramic heat exchange plate B; and
900: ceramic heat exchange core.

DETAILED DESCRIPTION OF THE INVENTION

The present invention will be further described as below with reference to the accompanying drawings.

Referring to the drawings, a ceramic heat exchange plate is provided, including a central heat exchange plate 120 having a plurality of upper fins 121 and lower fins 122 on an upper face and a lower face thereof, characterized in that the central heat exchange plate 120 has four sides and four corners; a second side 112 and a fourth side 114 are arranged in a lower portion of the corners, a linear groove is respectively arranged on outer side faces and bottoms of the second side 112 and the fourth side 114, and the linear groove on the outer side face of the second side 112 or the fourth side 114 and grooves on two corners form a U-shaped sealing groove 41; a first side 111 and a third side 113 are arranged in an upper portion of the corners, a top linear groove is respectively arranged on the outer side faces and tops of the first side 111 and the third side 113, and the linear groove on the outer side face of the first side 111 or the third side 113 and grooves on two corners form an inverted U-shaped sealing groove 42; the four sides have a same structure but a different mounting position and mounting direction; the four corners have a same structure and are mirror symmetrical to each other; the central heat exchange plate 120 is a flat plate; the upper fins 121 and the lower fins 122 are respectively arranged on the upper face and lower faces of the central heat exchange plate 120, the fin length directions of the upper fins 121 are arranged along the X-axis, and the fin length directions of the lower fins 122 are arranged along the Y-axis. The ceramic heat exchange plate o and a ceramic heat exchange core assembled thereby are provided, the ceramic heat exchange core including sealing strips 3 and the ceramic heat exchange plate 100; a plurality of ceramic heat exchange plates A 100 and a plurality of ceramic heat exchange plates B 200 are alternately superimposed; side sealing strips 3 are arranged inside top linear sealing grooves 43 of the ceramic heat exchange plates A 100 and bottom linear sealing grooves 44 of the ceramic heat exchange plates B 200; side sealing strips 3 are arranged inside top linear sealing grooves 43 of the ceramic heat exchange plates B 200 and bottom linear sealing grooves 44 of the ceramic heat exchange plates A 100; a plurality of ceramic heat exchange plates A 100, a plurality of ceramic heat exchange plates B 200 and a plurality of sealing strips 3 are assembled to form a ceramic heat exchange core 900; a solid face is respectively provided on an upper face and a lower face of the ceramic heat exchange core 900, a □-shaped groove A 45 is respectively arranged above and below a left end face and a right end face, and a □-shaped grooves B 46 is respectively arranged on a front side face and a rear side face; a U-shaped groove 41 is respectively arranged above the □-shaped grooves B 46, and an inverted U-shaped groove 42 is respectively arranged below the □-shaped grooves B 46; an end face porthole 50 is arranged in a left and right direction of the ceramic heat exchange core 900, a side face porthole 51 is arranged in a front and rear direction, and the end face porthole 50 and the side face porthole 51 are not communicated to each other; and the ceramic heat exchange core is integrally sintered.

Figure 4:
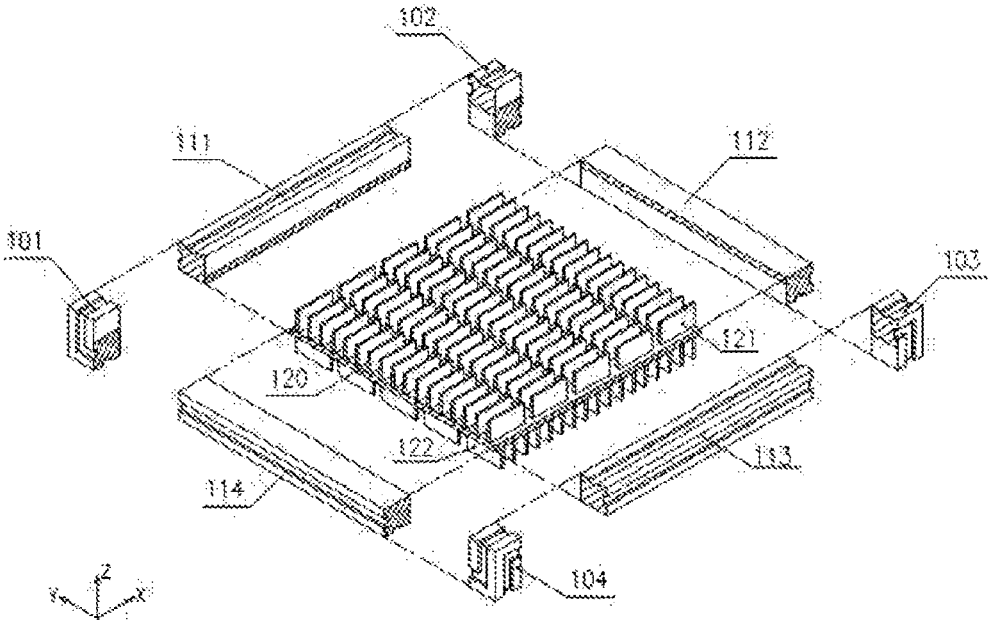
FIG. 4 is an exploded view of the ceramic heat exchange plate 100 of FIG. 1.

In the specific implementation, the ceramic heat exchange core 900 in this embodiment is a cube which has a length×width×height size of 300 mm×300 mm×300 mm. The ceramic heat exchange plates A 100 and the ceramic heat exchange plates B 200 are equal in length and width, and have a height which is ⅙ of the length. The three-dimensional size of the ceramic heat exchange plates 100 and 200 in this embodiment is 300 mm long, 300 mm wide and 50 mm high. The grooves 41, 42, 43, 44 are 10 mm wide and 3 mm deep. As shown in an exploded view of the ceramic heat exchange plate 100 of FIG. 4, the ceramic heat exchange plate 100 consists of a central heat exchange plate 120, upper fins 121, lower fins 122, and four corners (101, 102, 103, 104) and four sides (111, 112, 113, 114), the middle portion is a heat transfer portion, and the four sides and the four corners are bearing, sealing and connecting portions. As shown in FIG. 4, the fin length directions of the upper fins 121 and the lower fins 122 of the central heat exchange plate 120 form an included angle of 90°.

In this embodiment, the heat exchange plate 120 is assumed to be 300 mm long, 300 mm wide and 6 mm thick. The size and amount of the upper fins 121 and the lower fins 122 are consistent; the length of each fin is 52 mm, the height thereof is 20 mm, and the average thickness thereof is 4 mm. Both the upper fins 121 and the lower fins 122 are arranged in 21 rows and 5 columns, and have a row spacing of 14 mm and a column spacing of 10 mm. The four corners (101, 102, 103, 104) are mirror symmetric to each other. The four sides (111, 112, 113, 114) have a completely consistent structure but a different mounting position and mounting direction, the first side 111 and the third side 113 are mirror symmetric to each other, and the second side 112 and the fourth side 114 are mirror symmetric to each other. With respect to the central heat exchange plate 120, the first side 111 and the third side 113 are arranged above a lower face of the central heat exchange plate 120, and it is manifested in that the two sides move upward; and the second side 112 and the fourth side 114 are arranged below an upper face of the central heat exchange plate 120.

Figure 5:
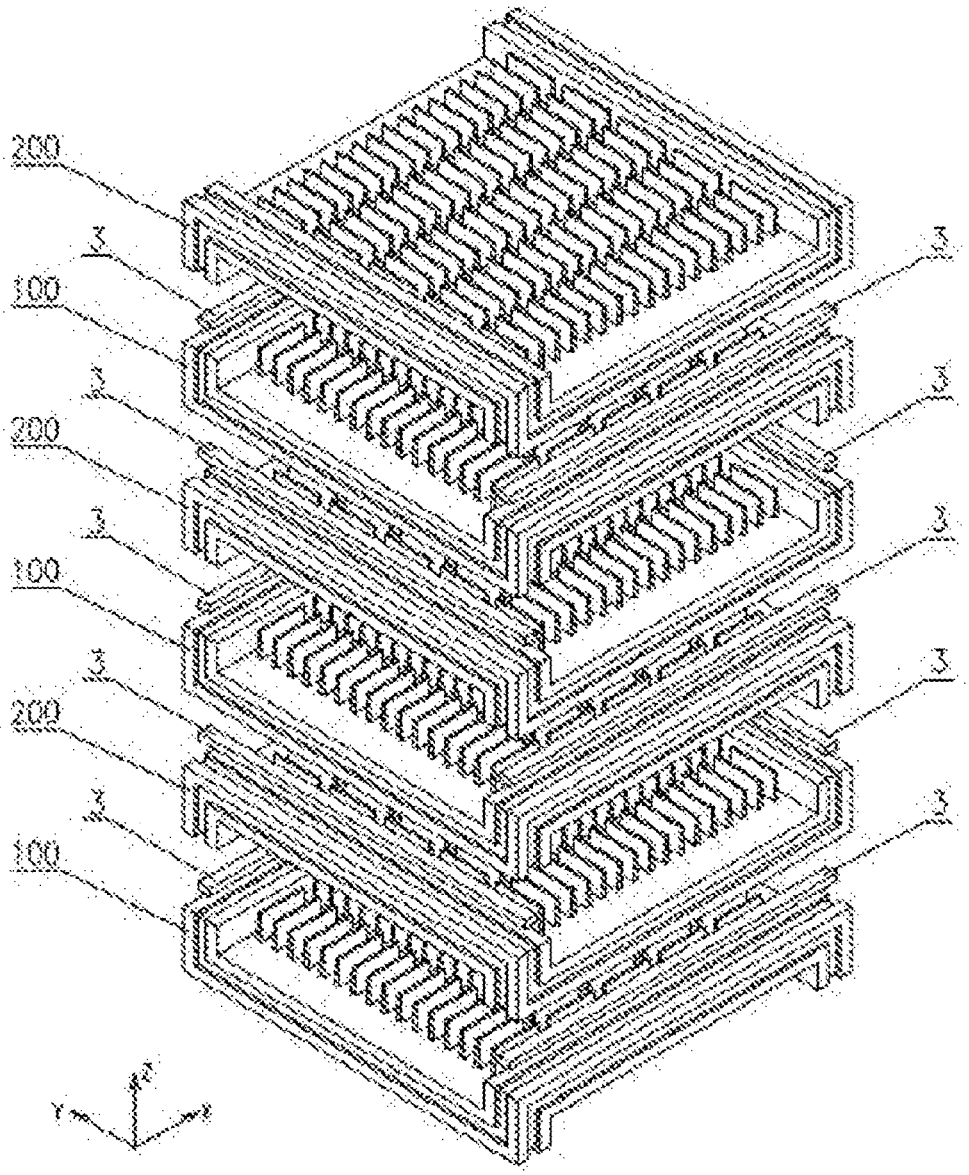
FIG. 5 is a schematic diagram of an assembly process for alternately superimposing three ceramic heat exchange plates 100 and three ceramic heat exchange plates 200.

FIG. 5 is a schematic diagram of an assembly process for alternately superimposing three ceramic heat exchange plates 100 and three ceramic heat exchange plates 200. From bottom to top, the first, third and fifth ones are ceramic heat exchange plates A 100, and the second, fourth and sixth ones are ceramic heat exchange plates B 200.

Sealing strips 3 are arranged in linear grooves between the ceramic heat exchange plates A 100 and the ceramic heat exchange plates B 200. The contact faces of the ceramic heat exchange plates A 100 and the ceramic heat exchange plates B 200 are coated with sintering material.

Figure 6:
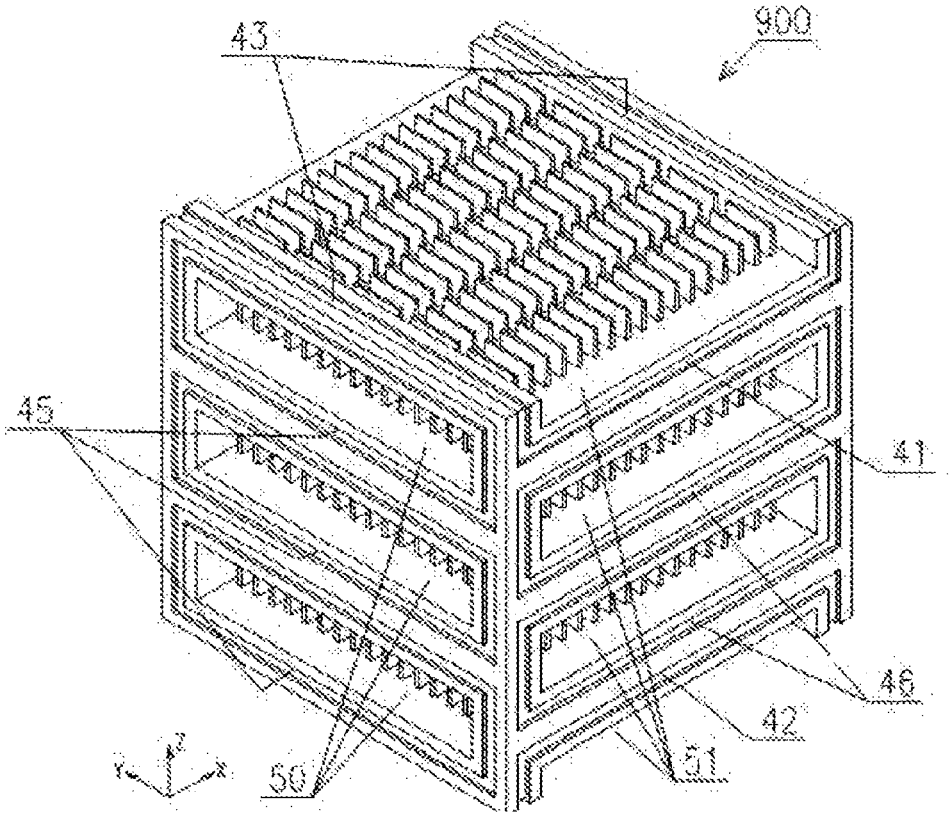
FIG. 6 is a three-dimensional top view of a ceramic heat exchange core 900 assembled as in FIG. 5 and integrally sintered (angle of view: absolute to WCS, 225° from the X-axis, 35.3° from the XY plane)
Figure 7:
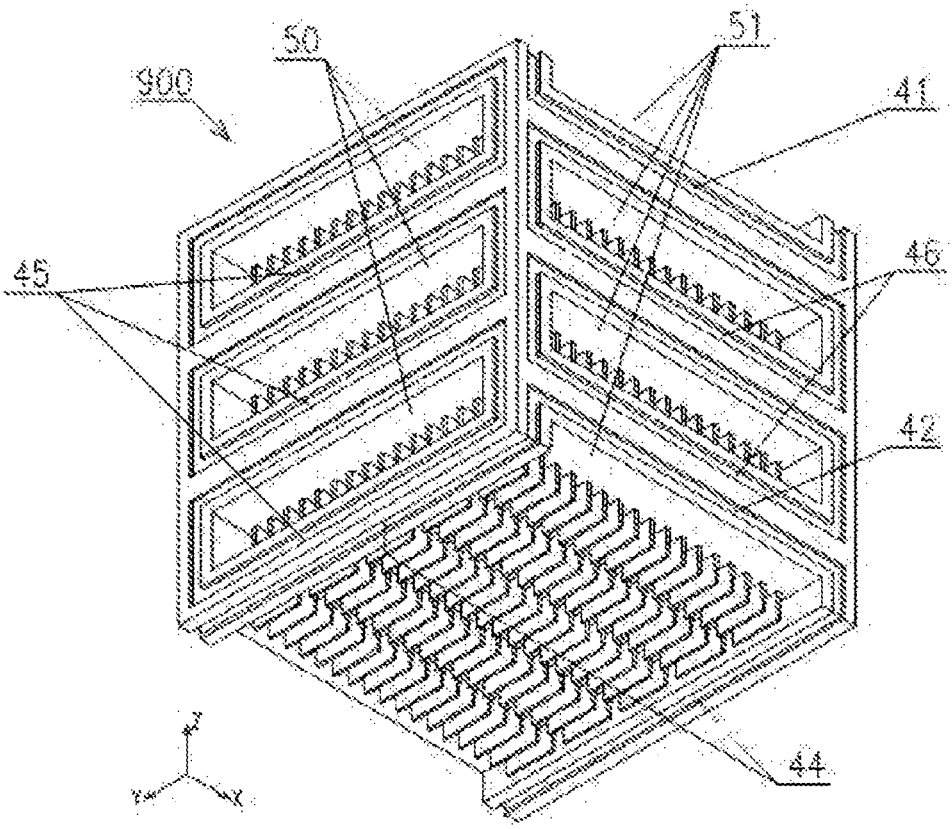
FIG. 7 is a three-dimensional bottom view of a ceramic heat exchange core 900 assembled as in FIG. 5 and integrally sintered (angle of view: absolute to WCS, 225° from the X-axis, −35.3° from the XY plane)

FIG. 6 is a three-dimensional top view of a ceramic heat exchange core 900 assembled as in FIG. 5 and integrally sintered (angle of view: absolute to WCS, 225° from the X-axis, 35.3° from the XY plane). As shown in FIG. 6, the ceramic heat exchange core 900 has six faces, among which, the upper face and the lower face are solid faces, and the surrounding four faces are open faces; the □-shaped grooves A 45 on the left end face and the right end face are not communicated to each other, and the end face portholes are communicated to each other in the left and right direction; the □-shaped grooves B 46 on the front side face and the rear side face of the ceramic heat exchange core 900, and one U-shaped groove 41 and one inverted U-shaped groove 42 are not communicated to each other, and side face portholes are communicated in the front and rear direction.

In the present invention, the ceramic heat exchange plate is made of ceramic material with excellent thermal conductivity, for example, silicon carbide ceramic, silicon nitride ceramic, combination of silicon nitride and silicon carbide, or silicon carbide composite material. In the flue gas waste heat recovery systems of various industrial furnaces and boilers, the air pre-heater assembled by the ceramic heat exchange cores may be used for waste heat recovery from the high-temperature flue gas and the medium- and low-temperature flue gas.

The invention claimed is:

1. A ceramic heat exchange plate, comprising a central heat exchange plate (120) having:

a flat plate with a first face and a second face that are opposite to each other, four sides consisting of a first side (111), a second side (112), a third side (113), a fourth side (114);

four corners consisting of a first corner (101), a second corner (102), a third corner (103), and a fourth corner (104);

a first array of fins (121), the first side (111), and the third side (113) disposed on the first face of the flat plate, wherein the first array of fins (121) comprises a plurality of rows of fins and a plurality of columns of fins, wherein the plurality of rows of fins, the first side (111), and the third side (113) are disposed along an X-axis; and a second array of fins (122), the second side (112), and the fourth side (114) disposed on the second face of the flat plate, wherein the second array of fins (122) comprises a plurality of rows of fins and a plurality of columns of fins, wherein the plurality of rows of fins, the second side (112), and the fourth side (114) are disposed along a Y-axis;

wherein the four sides, the four corners, and the central heat exchange plate (120) are assembled to form the first or the second ceramic heat exchange plate, wherein each of the first or the second ceramic heat exchange plate further comprises: a pair of U-shaped grooves, one defined on the second side (112), the second corner (102), and the third corner (103), the other defined on the fourth side (114), the second corner (102), and the third corner (103);

a pair of inverted U-shaped grooves, one defined on the first side (111), the first corner (101), and the second corner (102), the other defined on the third side (113), the third corner (103), and the fourth corner (104);

a first pair of linear grooves (44), one defined on the second side (112), the second corner (102), and the third corner (103), the other defined on the fourth side (114), the second corner (102), and the third corner (103); and a second pair of linear grooves (43), one defined on the first side (111), the first corner (101), and the second corner (102), and the other defined on the third side (113), the third corner (103), and the fourth corner (104).

2. A ceramic heat exchange core, comprising:

a plurality of heat exchange modules that include a first heat exchange module and a second heat exchange module, wherein each of the plurality of heat exchange modules comprises a first and a second ceramic heat exchange plates of claim 1, wherein the first ceramic heat exchange plate is superimposed on the second ceramic heat exchange plate along the Z-axis while the second ceramic heat exchange plate is rotated by 90° in an XY plane formed by the X-axis and the Y-axis, thereby: two side sealing strips (3) fill the second pair of grooves (43) of the second ceramic heat exchange plate and the first pair of grooves (44) of the first ceramic heat exchange plate, and wherein the first heat exchange module is superimposed on top of the second heat exchange module, thereby forming I-shaped sealing grooves (45) and II-shaped sealing grooves (46);

wherein a combined heat exchange core is integrally sintered.

* * * * *